US006984018B2

(12) United States Patent
Uetsuki et al.

(10) Patent No.: US 6,984,018 B2
(45) Date of Patent: Jan. 10, 2006

(54) RECORDING APPARATUS AND RECOVERY METHOD

(75) Inventors: Masaya Uetsuki, Kanagawa (JP); Toshiharu Inui, Kanagawa (JP); Takumi Kaneko, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 829 days.

(21) Appl. No.: 10/078,455

(22) Filed: Feb. 21, 2002

(65) Prior Publication Data

US 2002/0126308 A1 Sep. 12, 2002

(30) Foreign Application Priority Data

Feb. 23, 2001 (JP) ..... 2001-048967

(51) Int. Cl.
*B41J 2/165* (2006.01)

(52) U.S. Cl. ..... 347/33; 347/29; 347/30; 347/23; 347/32

(58) Field of Classification Search ..... 347/23, 347/24, 29, 30, 32, 33, 14, 19; 358/296
See application file for complete search history.

(56) References Cited

U.S. PATENT DOCUMENTS

| | | | | |
|---|---|---|---|---|
| 4,313,124 A | | 1/1982 | Hara | 346/140 R |
| 4,345,262 A | | 8/1982 | Shirato et al. | 346/140 R |
| 4,459,600 A | | 7/1984 | Sato et al. | 346/140 R |
| 4,463,359 A | | 7/1984 | Ayata et al. | 346/1.1 |
| 4,558,333 A | | 12/1985 | Sugitani et al. | 346/140 R |
| 4,608,577 A | | 8/1986 | Hori | 346/140 R |
| 4,723,129 A | | 2/1988 | Endo et al. | 346/1.1 |
| 4,740,796 A | | 4/1988 | Endo et al. | 346/1.1 |
| 5,341,163 A | * | 8/1994 | Hanabusa | 347/23 |
| 5,784,483 A | | 7/1998 | Takaragi et al. | 382/135 |
| 5,793,388 A | * | 8/1998 | Martinson et al. | 347/19 |
| 6,231,156 B1 | * | 5/2001 | Ono | 347/24 |
| 6,382,764 B1 | * | 5/2002 | Shimoda | 347/23 |
| 6,382,765 B1 | | 5/2002 | Kanda et al. | 347/23 |
| 6,557,969 B1 | | 5/2003 | Murakami et al. | 347/23 |
| 6,719,400 B2 | | 4/2004 | Inui et al. | 347/23 |
| 6,746,096 B2 | * | 6/2004 | Sakamoto et al. | 347/23 |

FOREIGN PATENT DOCUMENTS

| | | |
|---|---|---|
| JP | 54-56847 | 5/1979 |
| JP | 59-123670 | 7/1984 |
| JP | 59-138461 | 8/1984 |
| JP | 60-71260 | 4/1985 |
| JP | 64-71758 | 3/1989 |
| JP | 2-141248 | 5/1990 |
| JP | 7-125228 | 5/1995 |

* cited by examiner

*Primary Examiner*—Shih-wen Hsieh
(74) *Attorney, Agent, or Firm*—Fitzpatrick, Cella, Harper & Scinto

(57) ABSTRACT

An image forming apparatus having capping control means which, if a dot number counted by a count means reaches or exceeds a second threshold value smaller than a first threshold value and if a waiting time measured by a measuring means reaches or exceeds a first predetermined waiting time, covers an ink discharge surface of an ink jet recording head with a cap, and wiping control means which, if the dot number counted by the count means exceeds the first threshold value, wipes the ink discharge surface of the ink jet recording head with a wiper, and, if the waiting time measured by the measuring means reaches or exceeds a second predetermined waiting time longer than the first predetermined waiting time during the capping, wipes the ink discharge surface of the ink jet recording head with the wiper.

10 Claims, 12 Drawing Sheets

FIG. 12A

| NO. | CATEGORY | PAGE | K | C | M | Y |
|---|---|---|---|---|---|---|
| 1 | COLOR DOCUMENT | 3 | 5.0% | 0.0% | 0.5% | 0.8% |
| | | TOTAL A | 15.0% | 0.0% | 1.5% | 2.4% |

HALT FOR 55 SECONDS
CAPPING
HALT FOR 3 MINUTES

| | | | | | | |
|---|---|---|---|---|---|---|
| 2 | BLACK DOCUMENT | 3 | 3.5% | 0.0% | 0.0% | 0.0% |
| | | TOTAL B | 10.5% | 0.0% | 0.0% | 0.0% |
| | | TOTAL C | 25.5% | 0.0% | 0.0% | 0.0% |

ACCUMULATED VALUE FROM RECORDING START

HALT FOR 55 SECONDS
CAPPING
HALT FOR 5 MINUTES

| | | | | | | |
|---|---|---|---|---|---|---|
| 3 | COLOR DOCUMENT | 5 | 5.0% | 0.0% | 0.5% | 0.5% |
| | | TOTAL D | 25.0% | 0.0% | 1.5% | 1.5% |
| | | TOTAL E | 50.5% | 0.0% | 1.5% | 1.5% |

ACCUMULATED VALUE FROM RECORDING START

HALT FOR 55 SECONDS
WIPING
CAPPING
HALT FOR 2 MINUTES

| | | | | | | |
|---|---|---|---|---|---|---|
| 4 | GRAPHIC | 1 | 3.0% | 97.0% | 80.0% | 18.0% |
| | GRAPHIC | 1 | 11.0% | 78.0% | 69.0% | 26.0% |
| | | TOTAL | 14.0% | 175.0% | 149.0% | 44.0% |
| | WIPING | | | | | |
| | GRAPHIC | 1 | 5.0% | 97.0% | 80.0% | 18.0% |

HALT FOR 55 SECONDS
WIPING
CAPPING
HALT FOR 30 MINUTES

| | | | | | | |
|---|---|---|---|---|---|---|
| 5 | BLACK DOCUMENT | 5 | 8.0% | 0.0% | 0.0% | 0.0% |
| | | TOTAL A | 40.0% | 0.0% | 0.0% | 0.0% |

HALT FOR 55 SECONDS
CAPPING
HALT FOR 7 MINUTES

| | | | | | | |
|---|---|---|---|---|---|---|
| 6 | COLOR DOCUMENT | 3 | 5.0% | 0.0% | 0.5% | 0.5% |
| | | TOTAL B | 15.0% | 0.0% | 1.5% | 1.5% |
| | C=A+B | TOTAL C | 55.0% | 0.0% | 1.5% | 1.5% |

ACCUMULATED VALUE FROM PREVIOUS WIPING

HALT FOR 55 SECONDS
WIPING
CAPPING
HALT FOR 2 MINUTES

FIG. 12B

7

| | | | | | |
|---|---|---|---|---|---|
| COLOR DOCUMENT | 3 | 5.0% | 0.0% | 0.5% | 0.5% |
| | TOTAL A | 15.0% | 0.0% | 1.5% | 1.5% |

ACCUMULATED VALUE FROM PREVIOUS WIPING

HALT FOR 55 SECONDS
CAPPING
HALT FOR 3 MINUTES

8

| | | | | | |
|---|---|---|---|---|---|
| BLACK DOCUMENT | 3 | 3.5% | 0.0% | 0.0% | 0.0% |
| | TOTAL B | 10.5% | 0.0% | 0.0% | 0.0% |
| | TOTAL C | 25.5% | 0.0% | 0.0% | 0.0% |

ACCUMULATED VALUE FROM PREVIOUS WIPING

HALT FOR 55 SECONDS
CAPPING
HALT FOR 5 MINUTES

9

| | | | | | |
|---|---|---|---|---|---|
| COLOR DOCUMENT | 5 | 5.0% | 0.0% | 0.5% | 0.5% |
| | TOTAL D | 25.0% | 0.0% | 1.5% | 1.5% |
| | TOTAL E | 50.5% | 0.0% | 1.5% | 1.5% |

ACCUMULATED VALUE FROM PREVIOUS WIPING

HALT FOR 55 SECONDS
WIPING
CAPPING
HALT FOR 2 MINUTES

10

| | | | | | |
|---|---|---|---|---|---|
| COLOR DOCUMENT | 3 | 5.0% | 0.0% | 0.5% | 0.5% |
| | TOTAL | 15.0% | 0.0% | 1.5% | 1.5% |

HALT FOR 55 SECONDS
CAPPING
HALT FOR 60 MINUTES
WIPING
CAPPING

| | | |
|---|---|---|
| NUMBER OF WIPING | 5 | NUMBER |

IN EXCESS OF 100%

IN EXCESS OF 50%

FIG. 13A

| NO. | CATEGORY | PAGE | K | C | M | Y |
|---|---|---|---|---|---|---|
| 1 | COLOR DOCUMENT | 3 | 5.0% | 0.0% | 0.5% | 0.5% |
| | | TOTAL | 15.0% | 0.0% | 1.5% | 1.5% |
| | HALT FOR 55 SECONDS | | | | | |
| | WIPING BEFORE CAPPING | | | | | |
| | CAPPING<br>HALT FOR 3 MINUTES | | | | | |
| 2 | BLACK DOCUMENT | 1 | 3.5% | 0.0% | 0.0% | 0.0% |
| | | TOTAL | 3.5% | 0.0% | 0.0% | 0.0% |
| | HALT FOR 55 SECONDS | | | | | |
| | WIPING BEFORE CAPPING | | | | | |
| | CAPPING<br>HALT FOR 5 MINUTES | | | | | |
| 3 | COLOR DOCUMENT | 3 | 5.0% | 0.0% | 0.5% | 0.5% |
| | | TOTAL | 15.0% | 0.0% | 1.5% | 1.5% |
| | HALT FOR 55 SECONDS | | | | | |
| | WIPING BEFORE CAPPING | | | | | |
| | CAPPING<br>HALT FOR 2 MINUTES | | | | | |
| 4 | GRAPHIC | 1 | 3.0% | 97.0% | 80.0% | 18.0% |
| | GRAPHIC | 1 | 11.0% | 78.0% | 69.0% | 26.0% |
| | | TOTAL | 14.0% | 175.0% | 149.0% | 44.0% |
| | WIPING DURING RECORDING | | | | | |
| | GRAPHIC | 1 | 5.0% | 97.0% | 80.0% | 18.0% |
| | HALT FOR 55 SECONDS | | | | | |
| | WIPING BEFORE CAPPING | | | | | |
| | CAPPING<br>HALT FOR 30 MINUTES | | | | | |
| 5 | BLACK DOCUMENT | 5 | 8.0% | 0.0% | 0.0% | 0.0% |
| | | TOTAL A | 40.0% | 0.0% | 0.0% | 0.0% |
| | HALT FOR 55 SECONDS | | | | | |
| | WIPING BEFORE CAPPING | | | | | |
| | CAPPING<br>HALT FOR 7 MINUTES | | | | | |
| 6 | COLOR DOCUMENT | 3 | 5.0% | 0.0% | 0.5% | 0.5% |
| | HALT FOR 55 SECONDS | | | | | |
| | WIPING BEFORE CAPPING | | | | | |
| | CAPPING<br>HALT FOR 2 MINUTES | | | | | |

FIG. 13B

7

| | | | | | |
|---|---|---|---|---|---|
| COLOR DOCUMENT | 3 | 5.0% | 0.0% | 0.5% | 0.5% |
| | TOTAL | 15.0% | 0.0% | 1.5% | 1.5% |

HALT FOR 55 SECONDS

WIPING BEFORE CAPPING

CAPPING
HALT FOR 3 MINUTES

8

| | | | | | |
|---|---|---|---|---|---|
| BLACK DOCUMENT | 1 | 3.5% | 0.0% | 0.0% | 0.0% |
| | TOTAL | 3.5% | 0.0% | 0.0% | 0.0% |

HALT FOR 55 SECONDS

WIPING BEFORE CAPPING

CAPPING
HALT FOR 5 MINUTES

9

| | | | | | |
|---|---|---|---|---|---|
| COLOR DOCUMENT | 3 | 5.0% | 0.0% | 0.5% | 0.5% |
| | TOTAL | 15.0% | 0.0% | 1.5% | 1.5% |

HALT FOR 55 SECONDS

WIPING BEFORE CAPPING

CAPPING
HALT FOR 2 MINUTES

10

| | | | | | |
|---|---|---|---|---|---|
| COLOR DOCUMENT | 3 | 5.0% | 0.0% | 0.5% | 0.5% |

HALT FOR 55 SECONDS

WIPING BEFORE CAPPING

CAPPING
HALT FOR 60 MINUTES

| | | |
|---|---|---|
| NUMBER OF WIPING | 11 | NUMBER |

IN EXCESS OF 100%

IN EXCESS OF 50%

RECORDING APPARATUS AND RECOVERY METHOD

BACKGROUND OF THE INVENTION

1. Field of the Invention

The present invention relates to an image forming apparatus and a recovery method, and more particularly, it relates to an image forming apparatus comprising a recording head, and a recovery method.

2. Description of the Related Art

In ink jet recording apparatuses for office and home applications which have been popularized in the market, since liquid ink is used for recording, an ink discharge surface of an ink jet recording head must be wiped. In this case, generally, a wiping operation is controlled on the basis of dot count. For example, Japanese Patent Application Laid-Open No. 1-71758 (1989) discloses a technique for wiping and cleaning an ink discharge surface of an ink jet recording head when a predetermined dot number is counted.

Further, Japanese Patent Application Laid-Open No. 7-125228 (1995) and No. 2-141248 (1990) disclose a wiping sequence optimized by using both a timer and dot count.

In these techniques, by detecting contamination on the ink discharge surface of the recording head by the dot count and by ascertaining adhered and viscosity-increased ink by the timer, needless or excessive wiping effected in a less wet condition generated when the wiping is controlled by the timer alone and increase in ink viscosity caused if low duty is continued when the wiping is controlled by the dot count alone are prevented.

By the way, although the wiping itself is required for preventing the wetting of the ink discharge surface of the ink jet recording head and poor recording due to contaminant such as dirt, since the wiping is effected by rubbing the ink discharge surface of the ink jet recording head by means of a wiper member, depending upon various conditions such as an urging force, hardness of the wiper member, a wiping speed and the like, recording quality may be deteriorated due to deterioration of water repelling processing of the ink discharge surface of the ink jet recording head and damage of discharge ports of an ink discharge nozzles.

Further, the ink discharge surface of the ink jet recording head is generally formed from stainless steel, brass, glass or polysulfone/phenol resin. In many cases, although the ink discharge surface is formed from material having hardness greater than that of rubber, as the case may be, an ink droplet removing ability during the wiping may be reduced due to wear of the wiper itself, which results in poor ink discharging. Accordingly, although the wiping operation is required when the recording is effected by using the ink jet recording head, it is desirable that the frequency of the wiping operation be reduced as much as possible.

However, in the above-mentioned conventional techniques, since the wiping is effected before the ink jet recording head is capped, although the wiping based on the recording operation is not effected if the recording is effected with a small dot number, the wiping is ultimately effected when the capping is effected after the recording, and, thus, the wiping does not reach the required dot number, and actually, a similar operation when the lesser dot number is set as a threshold value for controlling the wiping operation will be effected. Namely, in the above-mentioned conventional techniques, the wiping operation may be effected at a timing which does not require the wiping operation, and, if such unnecessary wiping operations are repeated, the recording quality will be deteriorated.

SUMMARY OF THE INVENTION

An object of the present invention is to provide an image forming apparatus and a recovery method, in which the number of wiping operations can be reduced as much as possible.

Another object of the present invention is to provide a recording apparatus comprising a wiper for wiping an ink discharge surface of an ink jet recording head, a cap for covering the ink discharge surface of the ink jet recoding head, count means for counting a dot number of ink discharging from the ink jet recording head, measuring means for measuring a waiting time during when the ink discharging from the ink jet recording head is not effected, capping control means for effecting control in such a manner that, if the dot number counted by the count means reaches a second threshold value smaller than a first threshold value or exceeds the second threshold value and if the waiting time measured by the measuring means reaches a first predetermined waiting time or exceeds the first predetermined waiting time, the ink discharge surface of the ink jet recording head is covered by the cap, and wiping control means for effecting control in such a manner that, if the dot number counted by the count means exceeds the first threshold value, the ink discharge surface of the ink jet recording head is wiped by the wiper, and, if the waiting time measured by the measuring means reaches a second predetermined waiting time longer than the first predetermined waiting time or exceeds the second predetermined waiting time during the capping of the capping control means, the ink discharge surface of the ink jet recording head is wiped by the wiper.

A further object of the present invention is to provide a recovery method comprising a counting step for counting a dot number of ink discharging from an ink jet recording head, a first wiping step for wiping an ink discharge surface of the ink jet recording head by means of a wiper if the dot number counted in the counting step reaches a first threshold value or exceeds the first threshold value, a measuring step for measuring a waiting time during when the ink discharging from the ink jet recording head is not effected, a capping step for covering the ink discharge surface of the ink jet recording head by means of a cap if the dot number counted in the count step reaches a second threshold value smaller than the first threshold value or exceeds the second threshold value and if the waiting time measured in the measuring step reaches a first predetermined waiting time or exceeds the first predetermined waiting time, and a second wiping step for wiping the ink discharge surface of the ink jet recording head by means of the wiper if the waiting time measured in the measuring step reaches a second predetermined waiting time longer than the first predetermined waiting time or exceeds the second predetermined waiting time during the capping in the capping step.

According to the present invention, a timing of the wiping is controlled by using a threshold value different from the first threshold value used in the normal wiping control even when the wiping is effected in the past, and, ultimately, the number of wiping operations can be reduced by total recovery processing including temporary capping and the wiping effected after longer waiting time. As a result, unnecessary wiping can be avoided, deterioration of the recording head due to repeated wiping operations can be prevented, and, for example, service lives of a recording head in a recording apparatus such as a network printer in which the recording is effected frequently and of the recording apparatus itself can be extended.

BRIEF DESCRIPTION OF THE DRAWINGS

FIGS. 12A and 12B are views showing a result of recording of record data formed by application in order to ascertain an effect of the embodiment of the present invention; and FIGS. 13A and 13B are views showing a result obtained when the recording is effected in accordance with a conventional sequence, for comparing with FIGS. 12A and 12B.

DETAILED DESCRIPTION OF THE PREFERRED EMBODIMENTS

The present invention will now be fully explained in connection with preferred embodiments thereof with reference to the accompanying drawings. In the following explanation, although the expression "if a certain value is exceeded" is used, an embodiment in which such expression is replaced by the expression "if a certain value is reached" is also included in the present invention.

Figure 1:
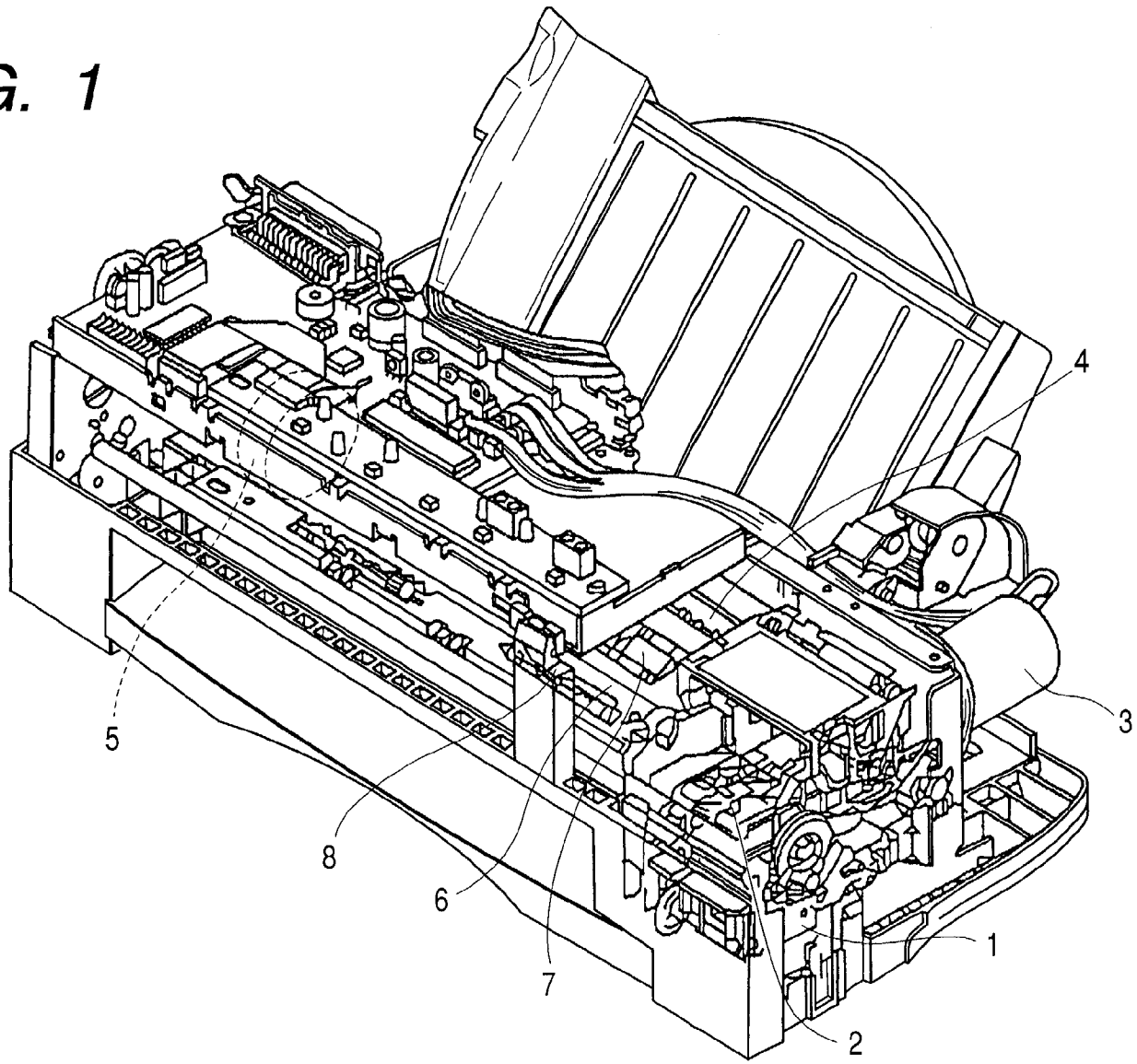
FIG. 1 is a perspective view of an ink jet printer according to a representative embodiment of the present invention.

FIG. 1 is a perspective view of an ink jet printer (referred to as "recording apparatus" hereinafter) according to a representative embodiment of the present invention. The ink jet printer is a recording apparatus of serial scan type in which recording is effected by discharging ink from an ink jet recording head (referred to merely as "recording head" hereinafter) toward a recording medium (for example, recording paper) while shifting a carriage on which the recording head is mounted in a direction (main scanning direction) perpendicular to a conveying direction (sub scanning direction) of the recording medium.

Now, a recording operation will be described briefly.

First of all, the recording medium is conveyed by a sheet feeding roller 6 driven by a sheet feeding motor 5 via gears. Then, a predetermined band width is recorded while scanning the carriage 2 by a carriage motor 3 in a direction perpendicular to the sub scanning direction, and, thereafter, the recording medium is conveyed by an amount corresponding to the band width. By repeating such operations, the band widths can successively be recorded.

However, in case of such serial scan recording, if necessary, there is a case where the recording medium is not conveyed even after the one-scan recording is finished and the recording medium is conveyed after the recording corresponding to plural scans is finished or a method in which the recording is effected by using data thinned by a predetermined mask every scan and the recording medium is fed by about an amount corresponding to (1/n) band and then the recording is effected again and an image is completed by repeating such operations by plural times (so-called multi-pass recording).

Incidentally, in the illustrated embodiment, while an example that the driving force is transmitted from the carriage motor 3 to the carriage 2 by using a carriage belt 4 was explained, other driving means such as a lead screw may be used in place of the carriage belt.

The fed recording medium is directed to a recording portion through a nip between the sheet feeding roller 6 and a pressure roller 7. In an inoperative condition, since the recording head is normally capped, upon recording, the cap is released to establish a condition that the carriage 2 can perform the scanning operation in the main scanning direction. Thereafter, when data required for one-scan recording is stored in a print buffer (not shown), the carriage 2 is scanned by the carriage motor 3, thereby effecting the recording.

Incidentally, although not shown in FIG. 1, the recording apparatus includes a sub-system for supplying the ink from an ink tank to the recording head. In the sub-system, the ink is sent from the main tank to the recording head through a tube and a joint. Further, the carriage 2 on which the recording head is mounted is supported on a shaft (not shown) extending in the main scanning direction along the carriage belt so that the carriage is scanned in parallel with the shaft to effect the recording.

The recording medium is not limited to the recording paper so long as it is suitable for the ink jet recording, and, for example, so-called plain paper, coat paper including an ink absorbing layer (provided on a paper) comprised of calcium carbonate, titanium oxide or aluminium oxide and binder, or films including an absorbing layer (provided on a polymer film) comprised of porous material for absorbing the ink may be sued.

Further, as water-soluble organic solvent used in the ink for effecting the recording in the recording apparatus according to the illustrated embodiment, any conventional solvents used in the conventional inks can be used substantially.

More specifically, an alkyl alcohol group having a carbon number of 1–5 such as methyl alcohol, ethyl alcohol, n-propyl alcohol, isopropyl alcohol, n-butyl alcohol, sec-butyl alcohol, tert-butyl alcohol, isobutyl alcohol and n-pentanol, an amine group such as dimethyl formamide and dimethyl acetamide, a ketone or keto-alcohol group such as acetone and diacetone alcohol, an ether group such as tetrahydrofuran and dioxane, oxyethylene or oxypropylene added polymer such as diethylene glycol, triethylene glycol, tetrathylene glycol, dipropylene glycol, tripropylene glycol, polyethylene glycol and polypropylene glycol, alkylene glycol group including carbon atoms having alkylene groups of 2–6 such as ethylene glycol, propylene glycol, trimethylene glycol, butylene glycol, 1,2,6-hexane triol and hexylene glycol, a low class alkyl ether group of polyhydric alcohol such as thiodiglycol, glycerol, ethylene glycol mono-methyl (or ethyl) ether, diethylene glycol mono-methyl (or ethyl) ether and triethylene glycol mono-methyl (or ethyl) ether, a low class dialkyl ether group of polyhydric alcohol such as triethylene glycol dimethyl (or diethyl) ether and tetraethylene glycol dimethyl (or diethyl) ether, sulfolane, N-methyl-2-pyrrolidone or 1,3-dimethyl-2-imidazolidinone can be used.

Contents of such water-soluble organic solvent is generally 1 to 49 weight % and preferably 2 to 30 weight % with respect to total weight of the ink.

Further, although the water-soluble organic solvent can be used solely or as mixture, when the solvent is used together with medium, most preferable liquid medium composition includes a kind of water-soluble high boiling point organic solvent, for example, polyhydric alcohol such as diethylene glycol, triethylene glycol and glycerol.

Figure 2:
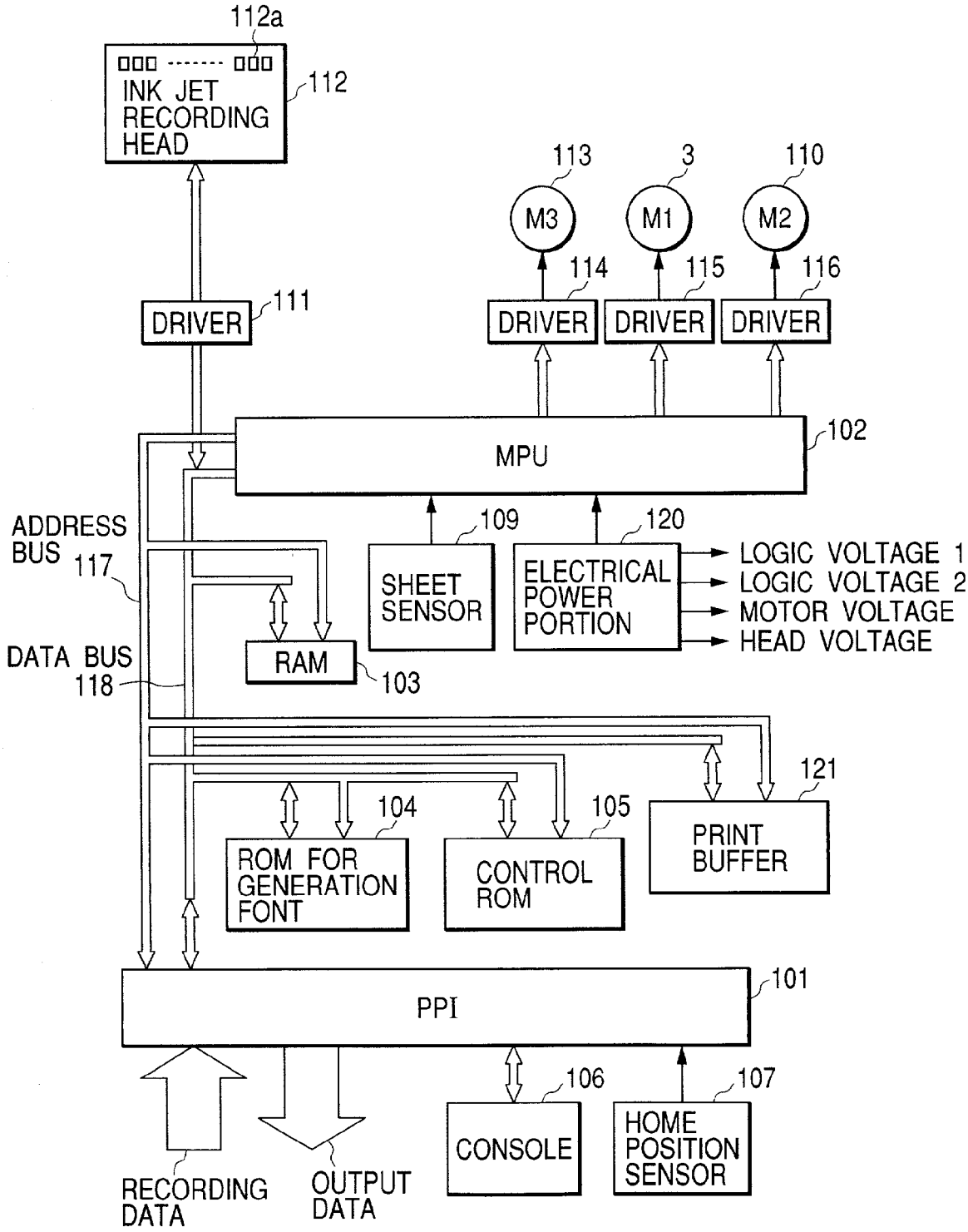
FIG. 2 is a block diagram showing a control arrangement of the recording apparatus of FIG. 1.

FIG. 2 is a block diagram showing a control arrangement of the recording apparatus of FIG. 1.

In FIG. 2, a programmable peripheral interface (referred to as "PPI" hereinafter) 101 serves to receive a command signal (command) and a record information signal sent from a host computer (not shown; referred to as "host" hereinafter) and to transfer such signals to an MPU 102 and also serves to effect control of console 106 and to receive a signal from a home position sensor 107 for detecting the fact that the carriage 2 is in a home position.

The MPU 102 serves to control various elements in the recording apparatus in accordance with a control program stored in a control ROM 105. A RAM 103 serves to store the received signal and is used as a work area of the MPU 102 to store various data temporarily. A font generating ROM 104 serves to store pattern information such as characters and recording in correspondence to code information and to output the pattern information in accordance with the inputted code information. Further, a print buffer 121 has capacity corresponding to m lines and serves to store data developed by the ROM 104. These elements are controlled by the MPU 102 via an address bus 117 and a data bus 118.

The carriage motor 3 generates the driving force for reciprocally shifting the carriage 2 on which the recording head 112 is mounted. Further, as mentioned above, the recording medium is conveyed by a convey motor 110 in a direction perpendicular to the shifting direction of the carriage 2.

The cap member is driven by a purge motor 113 to abut against ink discharge ports (not shown) of the recording head 112, thereby shielding the ink discharge ports from atmosphere to prevent the drying of the nozzles. Further, the purge motor 113 serves to drive the wiper to wipe the ink from the ink discharge surface (face surface) of the recording head.

The carriage motor 3, convey motor 110 and purge motor 113 are driven by a motor drivers 115, 116 and 114, respectively, under the control of the MPU 102.

Incidentally, the console 116 is provided with keyboard switches and display lamps. Further, the home position sensor 107 is disposed in the vicinity of the home position of the carriage to detect the fact that the carriage 2 on which the recording head is mounted reaches the home position.

Presence/absence of the recording medium (whether or not the recording medium is supplied to the recording portion) is detected by a sheet sensor 109.

The recording head used in the illustrated embodiment is an ink jet recording head of type in which an ink droplet is discharged by generating change in condition due to film boiling of the ink caused by thermal energy, and the recording head 112 is provided with m (for example, 64) discharge ports (not shown) and m (in number) discharging heaters 112*a* corresponding to the respective discharge ports, and the discharging heaters 112*a* of the recording head 112 are selectively driven by a record information signal.

The above-mentioned various elements of the apparatus are supplied with predetermined voltages (for example, logic voltages 1, 2, motor voltage, head voltage and the like) by a power supply (driving power supply device) 124 having an AC adaptor and a battery.

With the arrangement as mentioned above, the MPU 102 is connected to the host via the PPI 101 so that the recording operation is controlled by command and the record information signal sent from the host and by a processing sequence of the program stored in the control ROM 105 and by record information stored in the RAM 106.

In normal recording apparatuses and hosts conventionally used in technical fields to which the present invention is applied, when record data is sent from the host via a parallel port, an infrared port or a network, normally, a command describing the kind of medium (kind of recording medium such as plain paper, OHP sheet, glossy paper or the like, and kind of special recording medium such as a transfer film, a thick paper, banner paper or the like) on which the recording is effected at the head of data, a size of the recording medium (A4, A4 Letter, A3, B4, B5, Envelope or Post card), recording quality (draft, high quality, middle quality, emphasis of special color, kind of monochrome/color or the like), kind of sheet feeding cassette (ASF, manual insertion, bin 1, bin 2 or the like) and presence/absence of automatic discrimination of an object is sent. On the other hand, in the recording apparatus, such command is received and recognized, and, normally, a record pass number in the multi-pass recording, an ink discharging amount per unit area and a recording direction are determined and the recording is effected on the basis of them.

Further, as is the case may be, the recording apparatus can receive information regarding whether or not processing liquid (described later) is coated from the host as command.

In accordance with this information, in the recording apparatus, data required for the recording are read out from the ROM and the recording is effected on the basis of this data. Data read out from the ROM include kind of mask used in the recording when each pass is recorded, recording conditions of the recording head (for example, pulse shape to be applied, applying time and the like), as well as the above-mentioned data.

The ink tank (not shown) for supplying the ink to the recording apparatus is formed from resin such as PP, PE or the like by injection blowing and is assembled by using a technique such as supersonic welding, heat welding, adhesive, fitting or the like. The ink tank may be of type in which an ink chamber is defined by an outer frame, a bag for containing ink is provided within the ink tank, or a porous material is provided within the ink tank to hold the ink and generate negative pressure.

Further, when the negative pressure generating mechanism is provided in the ink tank, the negative pressure may be generated by supporting the bag within the ink tank in an expanding direction by means of a spring mechanism provided within or out of the bag.

Figure 3:
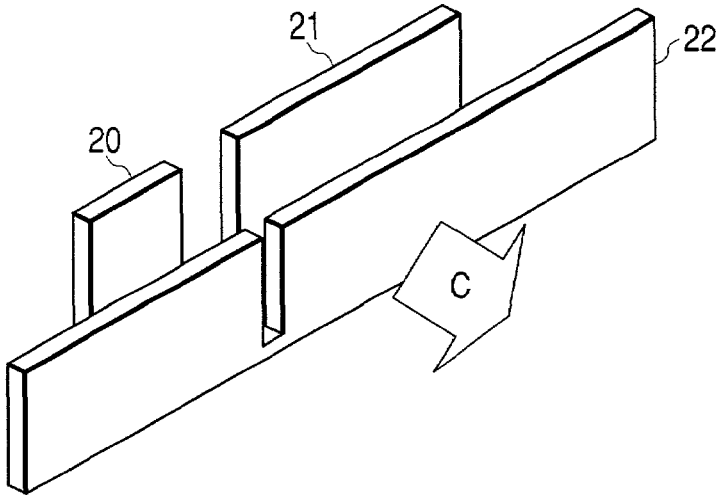
FIG. 3 is a perspective view of a wiper used in an embodiment of the present invention.
Figure 4:
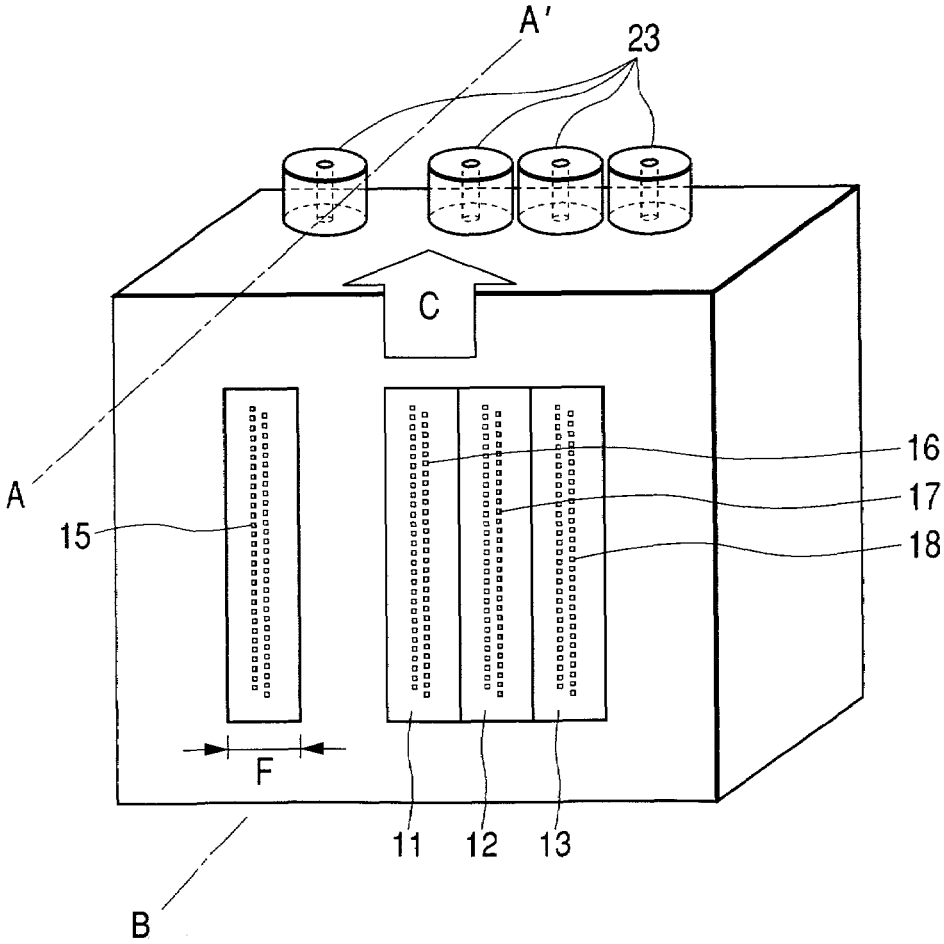
FIG. 4 is a perspective view of a recording head 112 used in an embodiment of the present invention.
Figure 5:
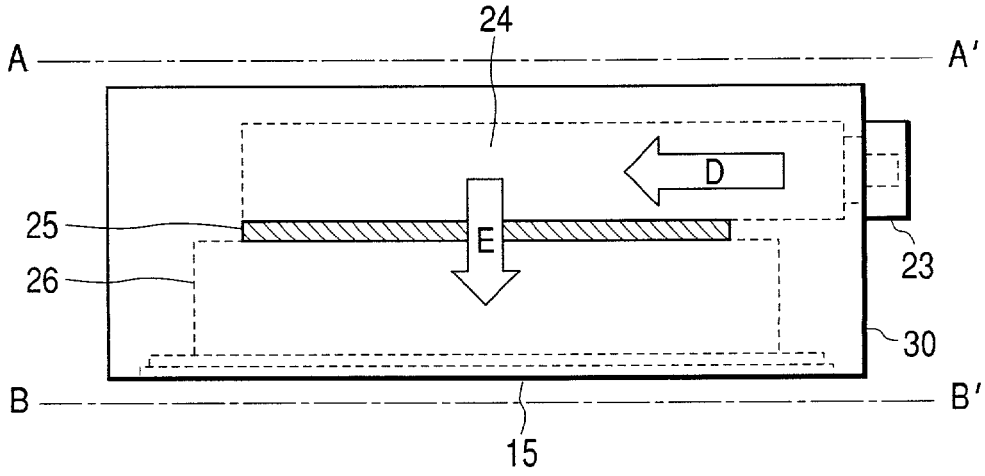
FIG. 5 is a sectional view of the recording head 112 of FIG. 4, taken along a plane A–A', B–B'.

FIG. 3 is a perspective view of the wiper used in the illustrated embodiment, FIG. 4 is a perspective view of the recording head 112 used in the illustrated embodiment, and FIG. 5 is a sectional view of the recording head 112 of FIG. 4, taken along a plane A–A', B–B'.

Explaining with reference to FIGS. 3 and 5, a width of a nozzle wiper 20 shown in FIG. 3 is selected to be smaller than a width F of a chip (referred to as "Bk chip" hereinafter)

15 used for discharging black ink shown in FIG. 4. The reason is that the chip is slightly retarded or recessed from the face surface as shown in FIG. 5 in order to avoid contact between the chip and the recording medium and the wiper can enter into the recess to effect the wiping operation.

For the same reason, a width of a wiper 21 for wiping face surfaces corresponding to chips (referred to as "color chips" hereinafter) 11, 12, 13 for discharging yellow, magenta and cyan color inks is selected to be smaller than a total width of these chips. A wiper 22 is a blade for wiping a TAB face 30, by which dirt and/or ink mist on a TAB 31 capped upon non-recording, power-off and suction are removed, thereby preventing air leakage due to poor contact of the cap and cap adhesion due to ink mist. Incidentally, in the recording head according to the illustrated embodiment, since the face surface is retarded or recessed from the TAB face 30, the wiper does not abut against the face surface.

The wipers shown in FIG. 3 are attached to a wiper holder (not shown) by using wiper fixing members (not shown), and positioning of the wipers is effected by fitting pins provided on the wiper holder into holes provided in the nozzle wipers 20, 21. The nozzle wipers 20, 21 are driven by the purge motor 113 toward a direction C shown in FIGS. 3 and 4 to wipe the orifices and the face surfaces. When the wiping operation is finished, the carriage 2 is retarded out of the wiping area, and the wipers are driven in an opposite direction to return them to a wiping start home position.

As shown in FIG. 4, 640 (in number) nozzles are arranged in the Bk chip 15 with density of about 236.2 nozzles/cm, and 1280 (in number) nozzles are arranged in each color chip with density of about 472.4 nozzles/cm.

In FIG. 5, the ink is supplied through a supply port 23 in a direction shown by the arrow D and is directed into an ink liquid chamber 24 above a filter within the recording head. Thereafter, the ink is advanced toward a direction shown by the arrow E, and a contaminant such as dirt included in the ink is removed by a filter 25. Then, the ink is directed to an ink liquid chamber 26 below the filter and then is directed to the nozzles (for discharging the ink) provided in a lower surface of the orifice plate.

Figure 6:
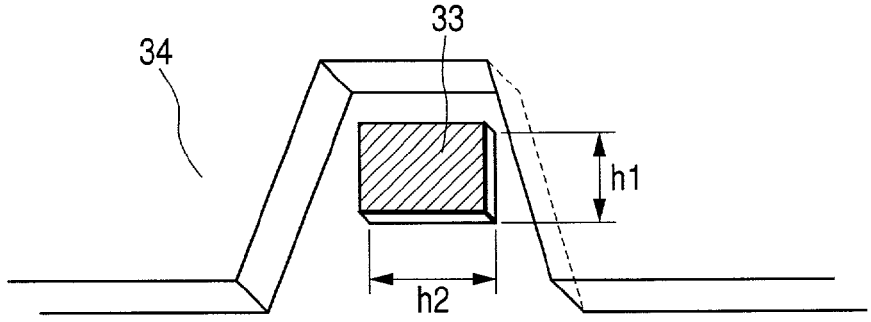
FIG. 6 is an enlarged view of a nozzle portion of the recording head of FIG. 4 used in the embodiment of the present invention.
Figure 7:
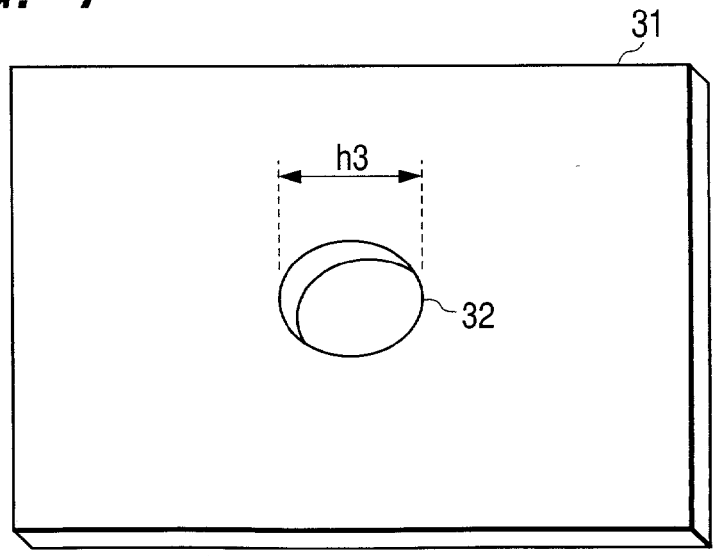
FIG. 7 is an enlarged view of a nozzle portion of the recording head of FIG. 4 used in the embodiment of the present invention.

FIGS. 6 and 7 are enlarged views showing the nozzle portion of the recording head of FIG. 4 used in the illustrated embodiment.

As shown in FIGS. 6 and 7, the ink liquid chamber is defined by the orifice plate 31, a liquid chamber forming member 34 and a heater board on which a heater 33 is mounted. The ink stored in the chamber is heated by the heater 33 to generate a bubble therein, with the result that the ink is pushed out through a discharge port 32 having a diameter "h3" of the orifice plate 31 by growth of the bubble. The discharged ink forms a spherical liquid droplet due to interface tension force between the ink and air, which droplet is flying toward the recording medium.

The recording apparatus according to the illustrated embodiment is designed to handle the recording medium having so-called A4 size. Thus, when total recording dots are fully recorded on the recording medium of A4 size, the recording dot number of 1.26×108 dots (20.32 cm×472.4 dots/cm×27.94 cm×472.4 dots/cm) becomes a maximum value in the color ink. Similarly, the recording dot number of 3.17×107 dots (=20.32 cm×236.2 dots/cm×27.94 cm×236.2 dots/cm) is a maximum recordable dot number in the black ink. Here, in the illustrated embodiment, while the recording dot number regarding the recording medium is counted, in the present invention, preliminary discharge dot number for recovery may be added to the recording dot number as dot number to be counted.

However, for simplifying the explanation of this example, it is assumed that the dot number is 100%, and the wiping operation is controlled on the basis of the fact how percentage of dots is recorded with respect to the dot number of 100%. Actually, the dot number counted by a dot counter is stored in the RAM, and, after the recording, it is judged whether the dot number reaches a predetermined threshold value.

In the illustrated embodiment, while the judgment whether the wiping is effected or not was effected after the recording of each page, in case of a plotter having a great recording area and a printer effecting the recording on a large size recording medium, the judgment whether the wiping is effected or not may be effected after each record scanning. Further, since ink mist adhered to the face surface may be changed by not only the dot count but also recording duty, the dot number may be increased or decreased by adding or subtracting coefficient calculated on the basis of the duty with respect to the dot number.

Next, processing for controlling the wiping operation in the illustrated embodiment will be explained with reference to flow charts.

Figure 8:
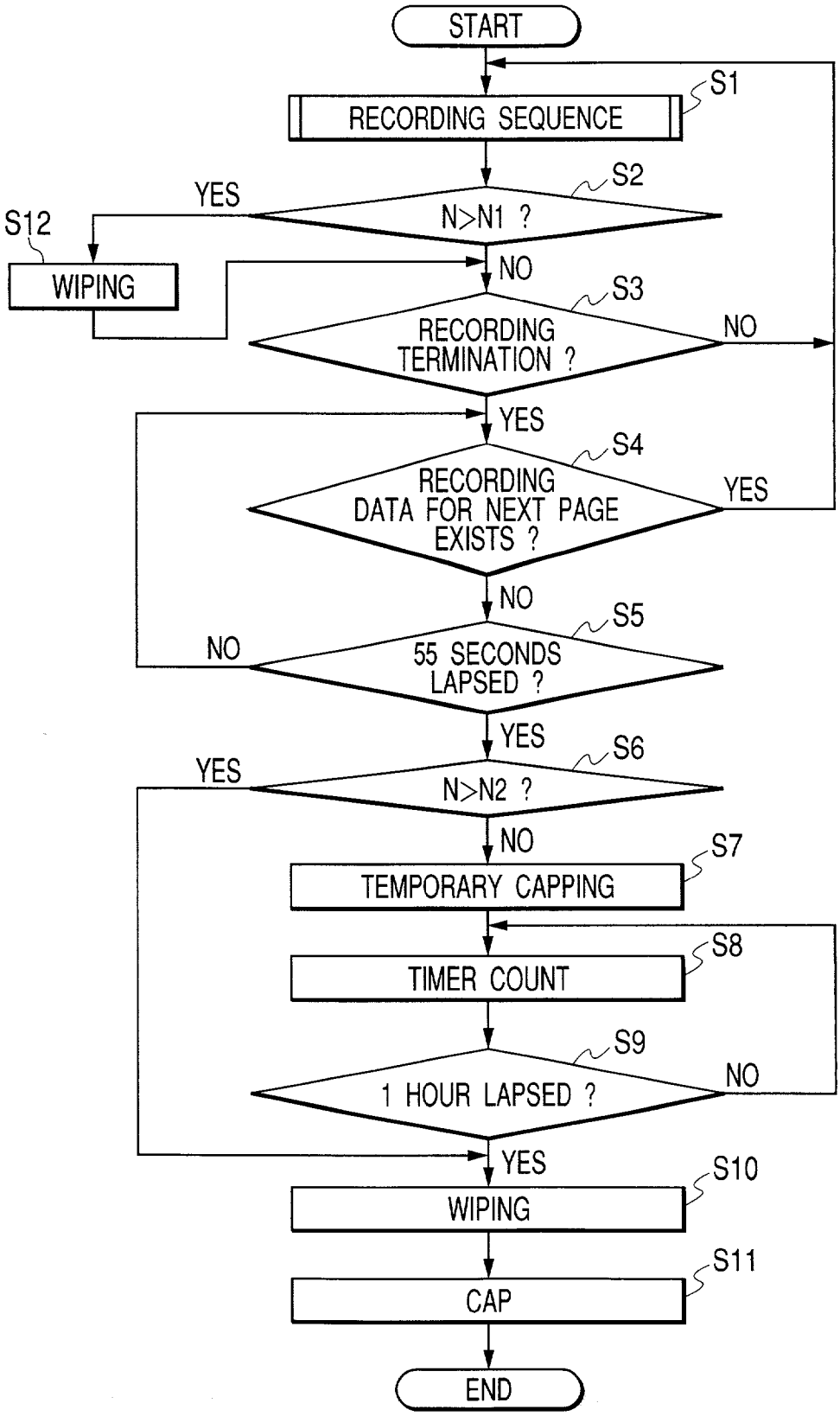
FIG. 8 is a flow chart showing control processing for a wiping operation according to an embodiment of the present invention.
Figure 9:
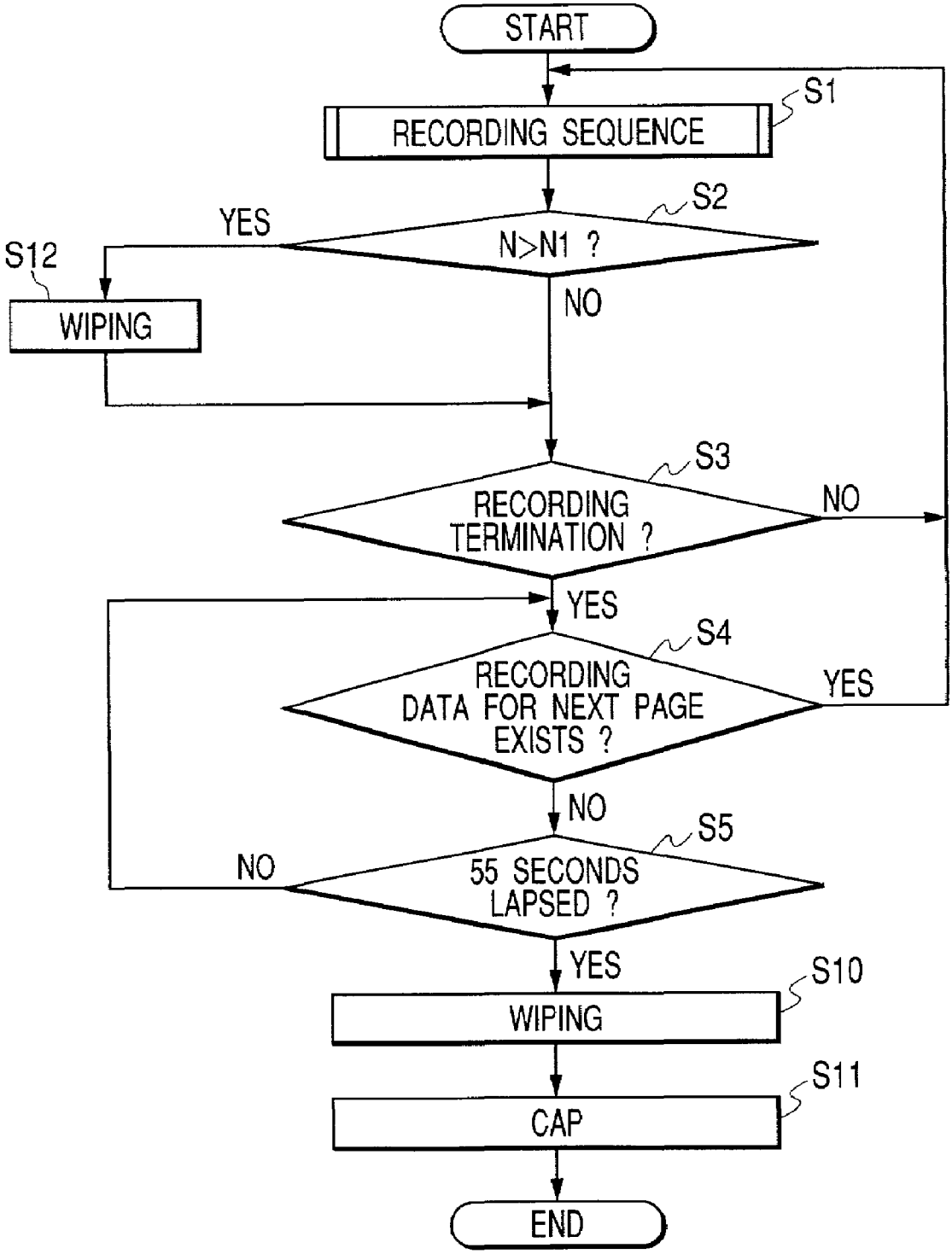
FIG. 9 is a flow chart showing control processing for a wiping operation in a conventional technique relating to the embodiment of the present invention.

FIG. 8 is a flow chart showing the processing for controlling the wiping operation according to the illustrated embodiment, and FIG. 9 is a flow chart showing the processing for controlling the wiping operation in the conventional technique relating to the illustrated embodiment of the present invention. In FIGS. 8 and 9, the same processing steps are designated by the same step reference numerals. Accordingly, by comparing these flow charts, advantages obtained by the present invention will be more apparent.

Figure 10:
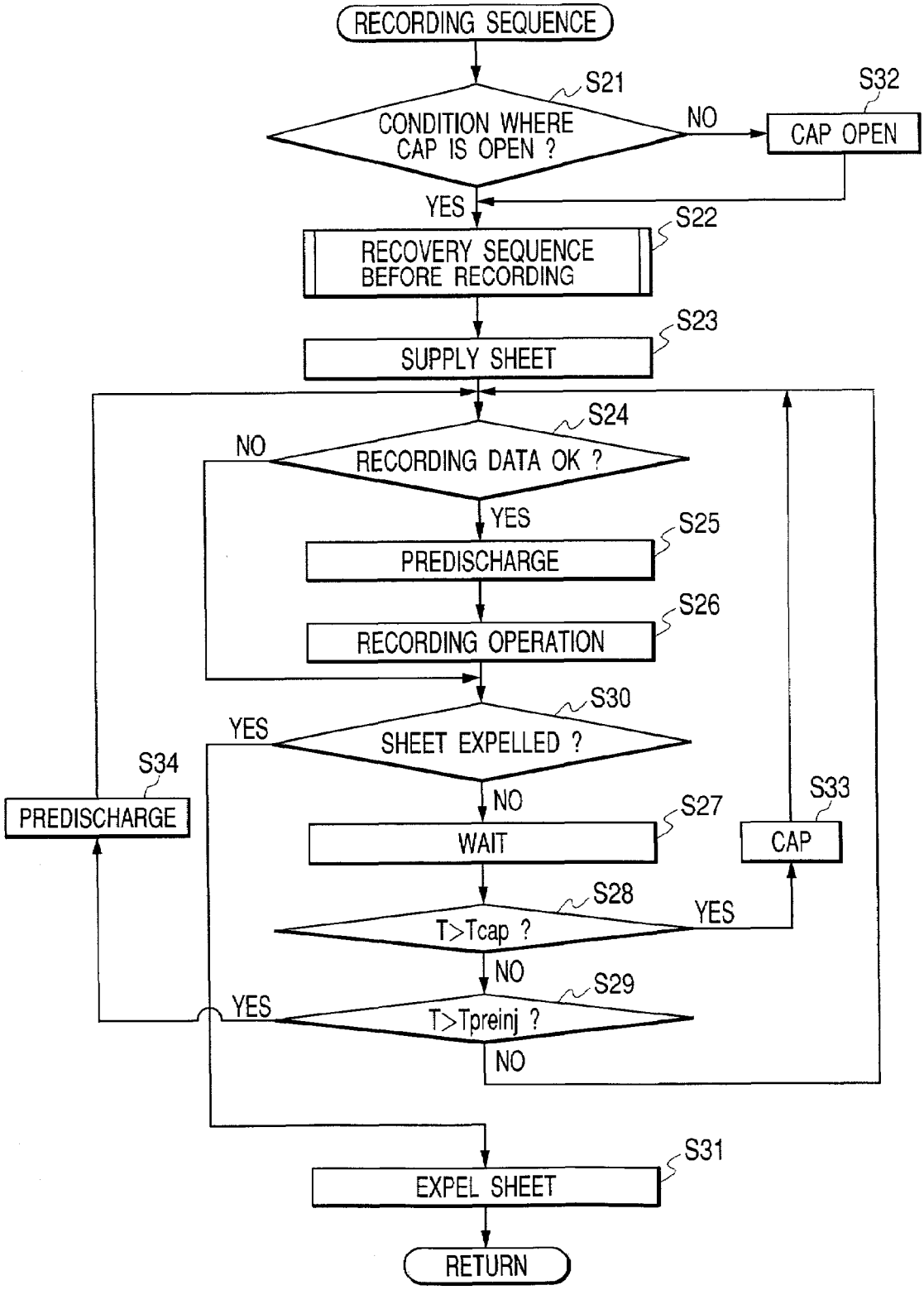
FIG. 10 is a flow chart showing a recording sequence in detail.

First of all, in a step S1, when the recording is started, the recording is effected in accordance with a recording sequence shown in a flow chart of FIG. 10.

The recording sequence will now be described with reference to FIG. 10.

First of all, in a step S21, a condition of the cap for making the recording head to a recordable condition is ascertained by a signal of the cap sensor. If the cap is capped on the recording head, the program goes to a step S32 where the cap is opened, and then, the program goes to a step S22. On the other hand, if the cap of the recording head is opened, the program goes to the step S22.

Then, in the step S22, a pre-recording recovery sequence is performed. The pre-recording recovery sequence generally includes suction, preliminary discharge and wiping effected on the basis of a timer or record history. Thereafter, in a step S23, the recording medium such as recording paper is supplied, and, in a step S24, it is checked whether one-scan data is stored in the print buffer 121. If the data is prepared, the program goes to a step S25, where the preliminary discharge is performed, and, in a step S26, the recording is executed. Thereafter, when one-scan recording is finished, the program goes to a step S30. On the other hand, if the recording data is not yet prepared, the program goes to the step S30 and the program waits until the data is prepared in the print buffer 121.

In the step S30, it is ascertained whether the sheet discharge command is received from the host. If the receipt of the sheet discharge command is ascertained, the program goes to a step S31, where the recording medium is discharged or expelled, and then, the recording operation is ended. However, if the receipt of the sheet discharge command cannot be ascertained, the program goes to a step S27, where the program waits by a predetermined time until the one-scan recording data is prepared. If the data is not prepared, the program goes to a step S28, where it is checked whether the waiting time (T) exceeds a predetermined threshold value (cap).

If T>Tcap, the program goes to a step S33, where the recording head is capped, and then, the program goes to the step S24, where the program waits until the data is prepared. On the other hand, if T≦Tcap, the program goes to a step S29, where the waiting time is compared with another threshold value (Tpreinj). Here, if T>Tpreinj, it is judged that a predetermined time is exceeded during the data waiting time in a cap open condition, and the program goes to a step S34, where the preliminary discharge is effected to prevent the poor discharging. Thereafter, the program is returned to the step S24.

The above explanation is the recording sequence. Incidentally, in the illustrated embodiment, while the preliminary discharge was effected every time before the recording corresponding to one scan, execution or non-execution of the preliminary discharge may be selected by a timer immediately before the recording.

When the recording sequence is finished, in a step S2, it is judged whether the recording dot number (N) exceeds a predetermined dot number (N1). If N>N1, the program goes to a step S12, where the wiping is executed. Thereafter, the program goes to a step S3. On the other hand, if N≦N1, the program goes to the step S3, where it is checked whether the recording operation should be ended or not. If it is judged that the recording operation should be continued, the program is returned to the step S1, where the recording sequence is executed again. On the other hand, if it is judged that the recording operation on the present recording medium should be finished, the program goes to a step S4.

In steps S4 and S5, the program waits by a time (55 seconds) until the recording head is capped while ascertaining whether there is recording data for a next page recording medium. If there is the recording data, the program is returned to the step S1, where the recording sequence is executed again. On the other hand, if there is no recording data, the program goes to a step S5, where the waiting time reaches 55 seconds or not. If there is no recording data and 55 seconds are elapsed, the program goes to a step S6.

Till now, the illustrated embodiment is the same as the conventional example.

However, after 55 seconds were elapsed, in the conventional example shown in FIG. 9, the program goes to a step S10, where the wiping is effected, and, in a step S11, the recording head is capped, and then, the recording operation is ended.

To the contrary, in the processing according to the illustrated embodiment shown in FIG. 8, after 55 seconds elapsed, in the step S6, the recording dot number (N) is compared with a second threshold value (N2). If N>N2 (N1>N2), the program goes to a step S10, where the wiping is effected as is in the conventional example, and, in a step S11, the recording head is capped, and then, the recording operation is ended.

However, if N≦N2, the program goes to a step S7, the recording head is capped temporarily to prevent further drying of the face surfaces of the recording head, and, in a step S8, a timer is set to monitor whether next recording is effected or not by 1 hour. Accordingly, in a step S9, it is checked whether the elapsed time of the timer reaches 1 hour or not. If the elapsed time exceeds 1 hour, the program goes to the step S10, where the wiping is effected as mentioned above, and, in the step S11, the recording head is capped, and then, the recording operation is ended.

By such control, for example, when the recording apparatus is used frequently via a network, there may be a case where the recording is desired to be effected immediately after the recording head is capped, the number of the wiping operations can be minimized in comparison with the conventional case where needless wiping may be effected even after small amount of recording under the control of the wiping operation performed only by the comparison with one threshold value.

Figure 11:
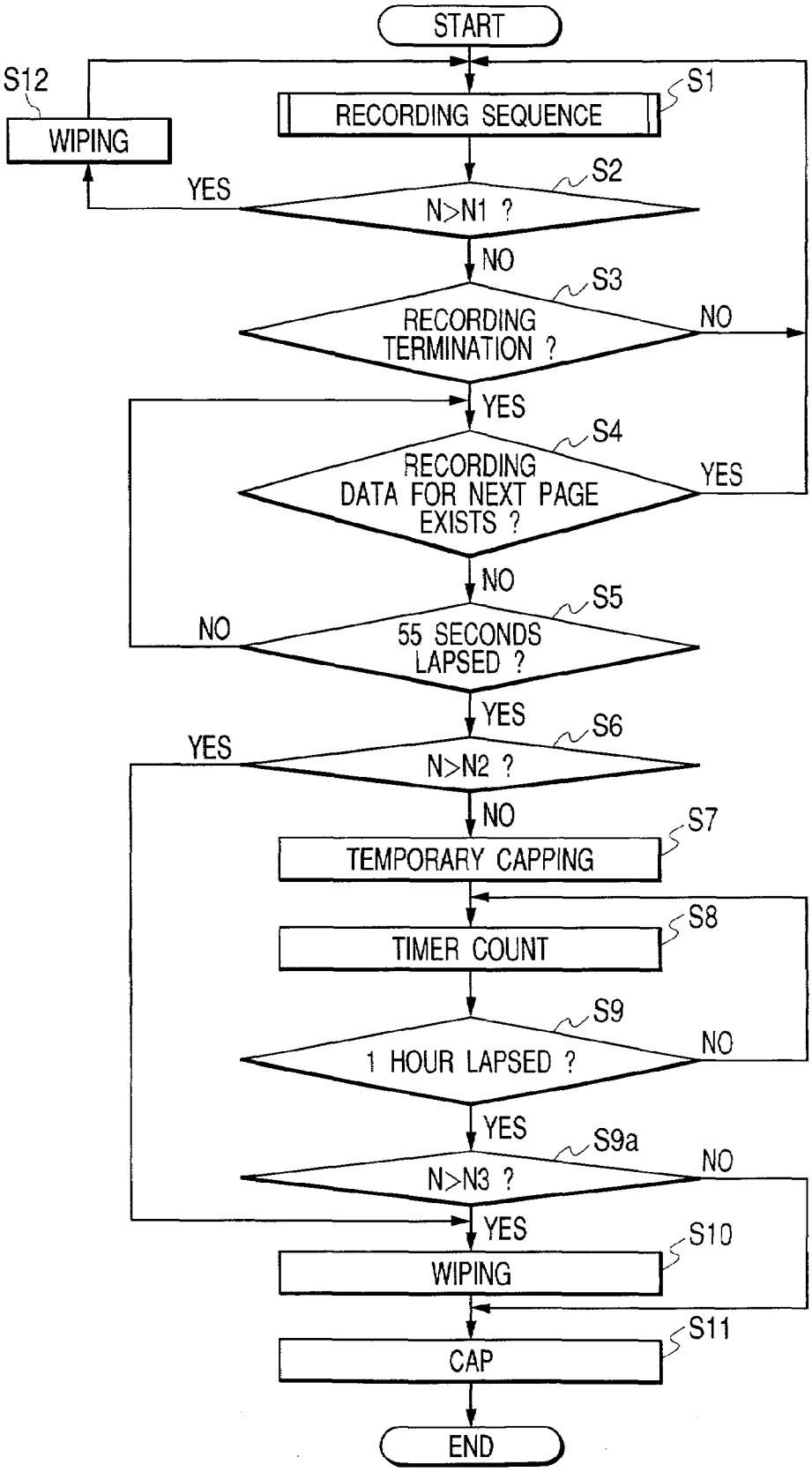
FIG. 11 is a flow chart showing alteration of processing for a wiping operation.

Incidentally, in the above-mentioned embodiment, while an example that the control of the wiping operation is effected by using two threshold values (N1, N2) was explained, the present invention is not limited to such an example. For example, as shown in a flow chart of FIG. 11, three threshold values (N1, N2, N3 (N2>N3)) may be used in such a manner that, in a step S9*a* of the flow chart, after the recording head is capped temporarily, when 1 hour is elapsed, it is checked again whether the threshold value (N3) is exceeded or not, and, if the threshold value is not exceeded (N≦N3), the wiping is not effected and the capped condition of the recording head is maintained.

By doing so, depending upon a pattern to be recorded, the number of wiping operations can further be reduced.

FIGS. 12A and 12B are views showing a result that the recording data formed by the application is recorded in order to ascertain the effect of the above-mentioned embodiment.

FIGS. 13A and 13B are views showing a result obtained when the recording is effected in accordance with the conventional sequence, for comparison.

Comparing these results with each other, in the sequence of the conventional example, as shown in FIGS. 13A and 13B, eleven (11) wiping operations are effected with respect to ten (10) print jobs, but, in the sequence according to the illustrated embodiment, only five (5) wiping operations are effected with respect to the same print jobs. Further, it was found that the recording quality in each job satisfies the specification.

In FIGS. 12A, 12B, 13A and 13B, an item "No." shown in the left end designates the number of the print job, and an item "category" adjacent to the item "No." designates a rough category or classification of a document to be handled by the print job, and, generally, in many cases, the category depends upon the application software formed. Explaining each recording pattern, the job number No. 1 (color document) indicates a normal document in which a highlight of yellow or red characters is included in a text document printed by black ink. Further, the job number No. 2 (Bk document) indicates a document in which text printed only by the black ink is included. The job number No. 3 (color document) indicates a document including the color recording partially, similar to the job number No. 1. The job number No. 4 (graphic) indicates a document including blue back normally used in an OHP sheet and the like.

An item "page" adjacent to the item "category" designates the number of printing parts. Further, items "K", "C","M" and "Y" designate percentages (%) of recording duty of four colors (black, cyan, magenta and yellow) used in the recording apparatus on which the recording head is mounted, with respect to the full-color image on the A4 size recording medium as mentioned above.

In FIGS. 12A, 12B, 13A and 13B, two threshold values regarding 50% and 100% of the recording duty are provided, and, the dot numbers actually counted in the recording apparatus are 6.30×107 dots and 1.26×108 dots in the case of the color ink and 1.58×107 dots and 3.17×107 dots.

Further, in FIGS. 12A, 12B, 13A and 13B, an item "total" below the item "page" designates a recording amount of pages immediately before each print job. Further, an item "total C" designates an accumulated value of "total A" (job number No. 1) and "total B" (job number No. 2). Similarly, an item "total E" designates an accumulated value till job number No. 13.

In summary, in the illustrated embodiment, a plurality of threshold values (N1, N2, N3) for judging whether or not the wiping is required are provided, so that (1) it is judged whether the wiping should be effected after one-page recording (comparison between N and N1), (2) it is judged whether the wiping should be effected when there is no recording data to be recorded and the predetermined time is elapsed (comparison between N and N2 (N1>N2)) and (3) it is judged whether the wiping should be effected when there is no recording data to be recorded for the further longer time during the waiting in the condition that the recording head is temporarily capped without effecting the wiping operation (comparison between N and N3 (N2>N3)). In this way, for example, if the recording duty is small, by temporarily deferring the execution of the wiping operation, the number of wiping operations can be minimized.

Incidentally, in the illustrated embodiments, while an example that the liquid droplet discharged from the recording head is ink and the liquid contained in the ink tank is ink was explained, the contained liquid is not limited to the ink. For example, liquid such as treatment liquid discharged toward the recording medium in order to enhance fixing ability and water-proofing of the recorded image and/or enhance the image quality may be contained in the ink tank.

In the above-mentioned embodiments, high density recording and highly fine recording can be achieved by particularly using a system (among ink jet recording systems) in which means (for example, electrothermal converter) for generating thermal energy utilized for discharging the ink is provided and the ink condition is changed by the thermal energy.

Regarding representative construction and principle thereof, for example, it is preferable that a fundamental principle disclosed in U.S. Pat. Nos. 4,723,129 and 4,740,796 is used. Although such system can be applied to both so-called on-demand type and continuous type, particularly, the on-demand type is effective since, by applying at least one drive signal for providing abrupt temperature increase exceeding nucleate boiling and corresponding to a recording signal to an electrothermal converter disposed in correspondence to a liquid path holding liquid (ink), thermal energy is generated in the electrothermal converter and film boiling is generated on a heat acting face of a recording head, with the result that a bubble corresponding to the drive signal by 1:1 can be created in the liquid (ink). At least one droplet is formed by discharging the liquid (ink) through a discharge port due to growth and contraction of the bubble. When the drive signal is of pulse type, since the growth and contraction of the bubble can be achieved promptly and properly, discharging of the liquid (ink) can be performed with excellent responsiveness and is more preferable.

As the drive signal of pulse type, signals disclosed in U.S. Pat. Nos. 4,463,359 and 4,345,262 are suitable. Incidentally, when conditions disclosed in U.S. Pat. No. 4,313,124 describing the invention regarding a temperature increasing rate of the heat acting face is adopted, further excellent recording can be achieved.

As the construction of the recording head, a construction in which a heat acting face is disposed in a curved area as disclosed in U.S. Pat. No. 4,558,333 or a construction as disclosed in U.S. Pat. No. 4,459,600 can be used in the present invention, as well as the construction (straight liquid flow path type or right angle liquid flow path type) including a combination of discharge ports, liquid paths and electrothermal converters as disclosed in the above-mentioned U.S. patents. In addition, the recording head may be constructed on the basis of Japanese Patent Application Laid-Open No. 59-123670 (1984) disclosing a construction in which a slot common to a plurality of electrothermal converters is used as a discharge port for the electrothermal converters or Japanese Patent Application Laid-Open No. 59-138461 (1984) disclosing a construction in which openings for absorbing pressure waves of thermal energy are corresponded to discharge ports.

Further, a recording head of full-line type having a length corresponding to a maximum recording medium available to the recording apparatus may be designed to satisfy the length by combination of plural recording heads or by a single integrally formed recording head, as disclosed in the above patent specifications.

In addition, not only a recording head of cartridge type in which an ink tank is integrally provided on the recording head itself explained in connection with the above-mentioned embodiment but also an exchangeable recording head of a chip type in which electrical connection to a main body of a recording apparatus and supplying of ink from the main body of the apparatus can be effected by mounting the recording head to the main body of the apparatus can be used.

Further, it is preferable that recovery means and preliminary means for the recording head are added to the above-mentioned recording head since the recording operation can be more stabilized. More concretely, these means include capping means, cleaning means and pressure or suction means for the recording head, and preliminary heating means comprised of an electrothermal converter or another heating element or combination thereof. Further, provision of a preliminary discharge mode for effecting the discharging different from the recording is also effective for the stable recording.

Further, as a recording mode of the recording apparatus, not only a recording mode mainly including black color, but also a recording mode including at least one of plural different colors or mixed full-color regardless of the fact that a plurality of recording heads are integrally formed or combined together can be used.

In the above-mentioned embodiments, while an example that the ink is liquid was explained, ink solidified at a temperature lower than room temperature but softened or liquefied at room temperature may be used, or, in the ink jet system, since it is common to control the temperature to maintain ink viscosity within a stable discharging range by adjusting the ink itself at a temperature range greater than 30° C. and smaller than 70° C., any ink may be used so long as the ink is liquefied upon application of a record signal.

In addition, in order to positively prevent a temperature increase by positively utilizing the thermal energy as energy for changing the ink from the solid form to the liquid form or to prevent evaporation of the ink, ink which is solidified in a stored condition and is liquefied by heating may be used. In any cases, the present invention includes a concept in which ink which is firstly liquefied by application of thermal energy, such as a concept in which ink is liquefied by application of thermal energy in response to a record signal and the liquefied ink is discharged or a concept in which ink starts to be solidified at a time when the ink reaches a recording medium. In this case, the ink may be disposed in a confronting relationship to the electrothermal converter in a condition that the ink is held in a porous sheet recessed portion or a through-opening in the liquid form or the solid form, as disclosed in Japanese Patent Application Laid-Open Nos. 54-56847 (1979) and 60-71260 (1985). In the present invention, film boiling is most effective to the above-mentioned inks.

Furthermore, the recording apparatus according to the present invention may be provided integrally or separately as an image output terminal of an information processing equipment such as a computer or may be used as a copying apparatus combined with a reader or a facsimile apparatus having a communication function.

Incidentally, the present invention may be applied to a system comprised of plural pieces of equipment (for example, host computer, interface equipment, reader, printer and the like) or an apparatus comprised of a single piece of equipment (for example, copying apparatus, facsimile apparatus or the like).

Further, it should be noted that the object of the present invention can be achieved by supplying a storing medium (or recording medium) storing a program code of software for executing the functions of the above-mentioned embodiments to the system or the apparatus and by reading out and executing the program code stored in the storing medium by means of a computer (or CPU or MPU) of the system or the apparatus. In this case, the program code itself read out from the storing medium realizes the functions of the above-mentioned embodiments, and, thus, the storing medium storing such program code constitutes the present invention. Further, it should be noted that the present invention includes a concept that not only the functions of the above-mentioned embodiments are realized by executing the program code read out by means of the computer, but also OS (operating system) running on the computer executes the actual processing partially or totally on the basis of instruction of the program code to realize the functions of the embodiments.

Further, it should be noted that the present invention includes a concept that, after the program code read out from the storing medium is written in a memory of a function expansion board inserted into the computer or a function expansion unit connected to the computer, a CPU of the function expansion board or of the function expansion unit executes the actual processing partially or totally on the basis of instruction of the program code to realize the functions of the embodiments.

What is claimed is:

1. A recording apparatus comprising:

a wiper for wiping an ink discharge surface of an ink jet recording head;

a cap for covering said ink discharge surface of said ink jet recording head;

count means for counting a dot number of ink discharging from said ink jet recording head;

measuring means for measuring a waiting time during when the ink discharging from said ink jet recording head is not effected;

capping control means for effecting control in such a manner that, if the dot number counted by said count means reaches a second threshold value smaller than a first threshold value or exceeds the second threshold value and if the waiting time measured by said measuring means reaches a first predetermined waiting time or exceeds the first predetermined waiting time, said ink discharge surface of said ink jet recording head is covered by said cap; and wiping control means for effecting control in such a manner that, if the dot number counted by said count means exceeds the first threshold value, said ink discharge surface of said ink jet recording head is wiped by said wiper, and, if the waiting time measured by said measuring means reaches a second predetermined waiting time longer than the first predetermined waiting time or exceeds the second predetermined waiting time during the capping of said capping control means, said ink discharge surface of said ink jet recording head is wiped by said wiper.

2. A recording apparatus according to claim 1, wherein said wiping control means effects control in such a manner that, if the dot number counted by said count means is equal to or greater than the second threshold value, said ink discharge surface of said ink jet recording head is wiped by said wiper.

3. A recording apparatus according to claim 1, wherein said wiping control means effects control in such a manner that, if the dot number counted by said count means is below a third threshold value smaller than the second threshold value, said ink discharge surface of said ink jet recording head is not wiped by said wiper.

4. A recording apparatus according to claim 3, wherein said wiping control means effects control in such a manner that, if the dot number counted by said count means is below the third threshold value, said ink discharge surface of said ink jet recording head is covered by said cap and a series of recording operations is ended.

5. A recording apparatus according to claim 1, wherein said ink jet recording head includes an electrothermal converter for generating thermal energy utilized for discharging the ink.

6. A recording apparatus according to claim 1, wherein said wiping control means effects control in such a manner that the dot number counted by said count means is compared with the first threshold value whenever recording corresponding to one page of a recording medium is finished, and said ink discharge surface of said ink jet recording head is wiped by said wiper in accordance with a comparison result.

7. A recovery method comprising:

a counting step for counting a dot number of ink discharging from an ink jet recording head;

a first wiping step for wiping an ink discharge surface of said ink jet recording head by means of a wiper if the dot number counted in said counting step reaches a first threshold value or exceeds the first threshold value;

a measuring step for measuring a waiting time during when the ink discharging from said ink jet recording head is not effected;

a capping step for covering said ink discharge surface of said ink jet recording head by means of a cap if the dot number counted in said count step reaches a second threshold value smaller than the first threshold value or exceeds the second threshold value and if the waiting time measured in said measuring step reaches a first predetermined waiting time or exceeds the first predetermined waiting time; and a second wiping step for wiping said ink discharge surface of said ink jet recording head by means of said wiper if the waiting time measured in said measuring step reaches a second predetermined waiting time longer than the first predetermined waiting time or exceeds the second predetermined waiting time during the capping in said capping step.

8. A recovery method according to claim 7, wherein, in said second wiping step, if the dot number counted in said counting step is equal to or greater than the second threshold value, said ink discharge surface of said ink jet recording head is wiped by said wiper.

9. A recovery method according to claim 7, wherein, in said second wiping step, if the dot number counted in said counting step is below a third threshold value smaller than the second threshold value, said ink discharge surface of said ink jet recording head is not wiped by said wiper.

10. A recovery method according to claim 9, wherein, in said capping step, if the dot number counted in said counting step is below the third threshold value, said ink discharge surface of said ink jet recording head is covered by said cap and a series of recording operations is ended.

* * * * *

UNITED STATES PATENT AND TRADEMARK OFFICE

CERTIFICATE OF CORRECTION

PATENT NO. : 6,984,018 B2
APPLICATION NO. : 10/078455
DATED : January 10, 2006
INVENTOR(S) : Masaya Uetsuki et al.

It is certified that error appears in the above-identified patent and that said Letters Patent is hereby corrected as shown below:

COLUMN 2
Line 13, “recoding” should read --recording--.

COLUMN 4
Line 46, “sued” should read --used--.
Line 60, “tetrathylene” should read --tetraethylene--.

COLUMN 5
Line 52, “a motor drivers” should read --motor drivers--.

COLUMN 6
Line 35, “as is the” should read --as the--.
Line 50, “of type” should read --of a type--.

COLUMN 8
Line 3, “how” should read --how a--.

COLUMN 9
Line 13, “the poor” should read --poor--.
Line 54, “as is in” should read --as in--.

COLUMN 10
Line 7, “small” should read --a small--.

Signed and Sealed this

Tenth Day of July, 2007

JON W. DUDAS
*Director of the United States Patent and Trademark Office*